United States Patent [19]

Sanders

[11] 4,070,853

[45] Jan. 31, 1978

[54] OPEN TOP PLASTIC BAG SEALER

[75] Inventor: Duane Sanders, Spokane, Wash.

[73] Assignee: Thermoguard Insulation Company, Spokane, Wash.

[21] Appl. No.: 757,874

[22] Filed: Jan. 10, 1977

[51] Int. Cl.[2] ..... B65B 7/06; B65B 51/14

[52] U.S. Cl. ..... 53/373

[58] Field of Search ..... 53/371, 373, 139, 187, 53/386

[56] References Cited

U.S. PATENT DOCUMENTS

| | | | |
|---|---|---|---|
| 2,114,624 | 4/1938 | Bergstein | 53/373 |
| 2,243,805 | 5/1941 | Knapp | 53/371 |
| 2,624,995 | 1/1953 | Allen | 53/371 |
| 3,115,736 | 12/1963 | Peterson | 53/371 |
| 3,167,897 | 2/1965 | Hopkins et al. | 53/139 |
| 3,220,161 | 11/1965 | Lohse et al. | 53/373 |
| 3,398,503 | 8/1968 | Bertoglio | 53/187 |

*Primary Examiner*—Travis S. McGehee
*Assistant Examiner*—Horace M. Culver
*Attorney, Agent, or Firm*—Wells, St. John & Roberts

[57] ABSTRACT

A machine is described for closing and sealing the upward ends of filled plastic bags. It includes a locating mechanism that positions bags successively at a closing and sealing station. The normally flexible top of each partially filled bag is formed into an upwardly open rectangular configuration by a forming mechanism. A folding mechanism operates to fold transverse short sides of the configuration inwardly. A heat element and associated pad are located on opposite longitudinal sides of the bag. They are pressed together against the folded longitudinal sides to heat the material and allow the sides to fuse together and seal the bag.

8 Claims, 10 Drawing Figures

2
56
46
56
58
57
57
43
44
74
65
55
10
62
69
62
68
64
44
45
45
43
60
61
27
79
59
65
24
14
78
11
12
78
47
47
41
17
26
26
41
77
76
76
77
75
75
23
28
28
73
72
42
42
2
34
13
32
35
35
25
36
37

FIG 7
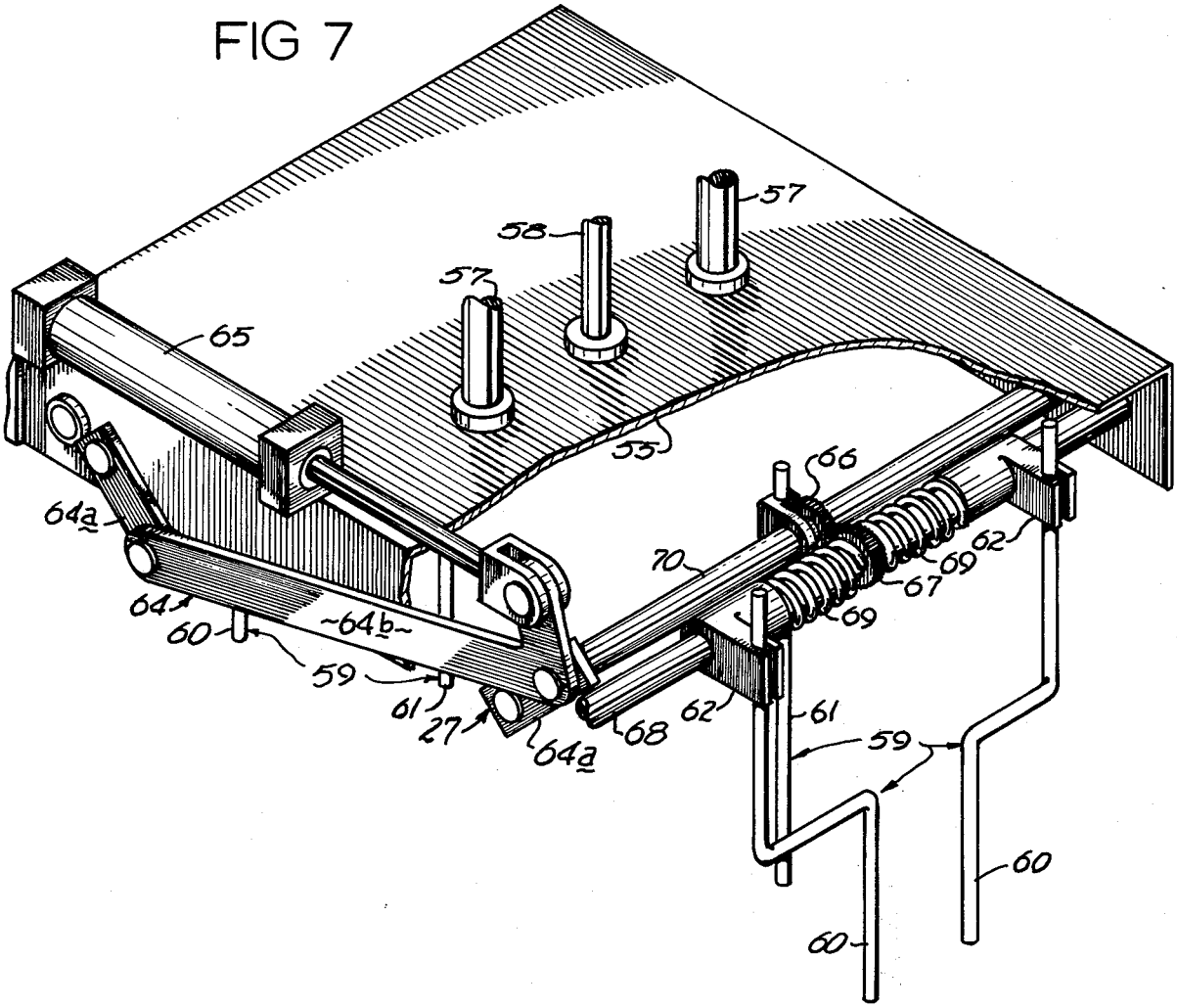
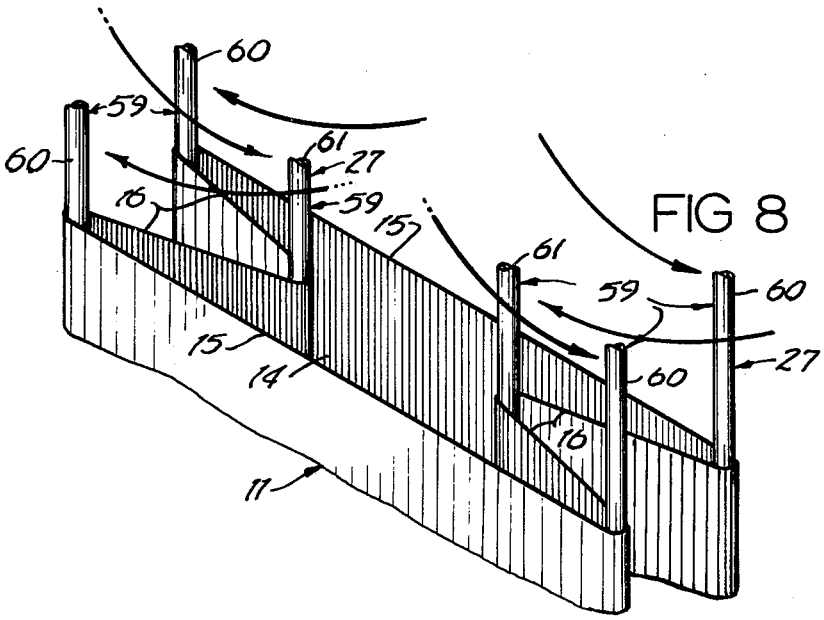
FIG 8

FIG 9
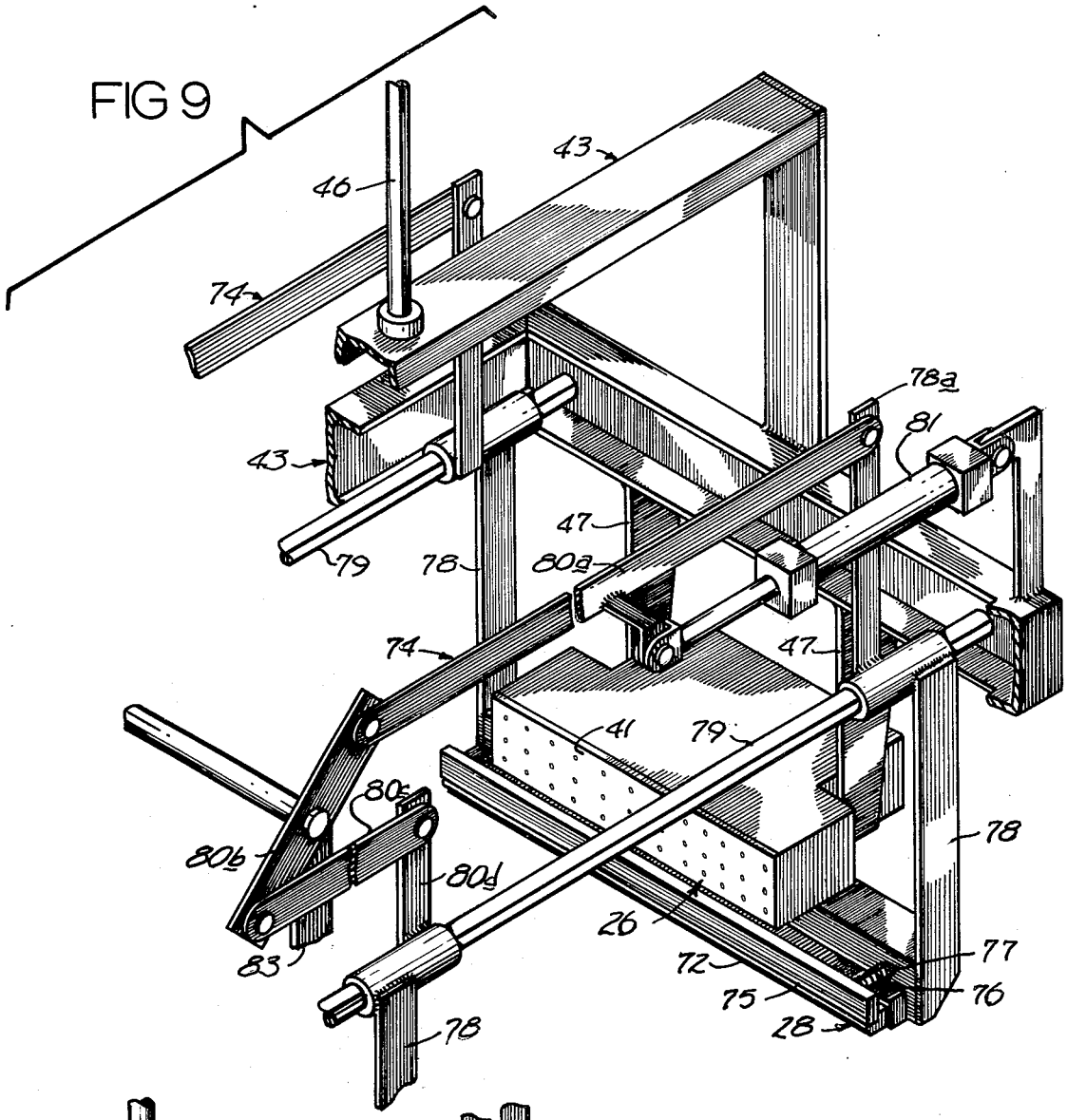
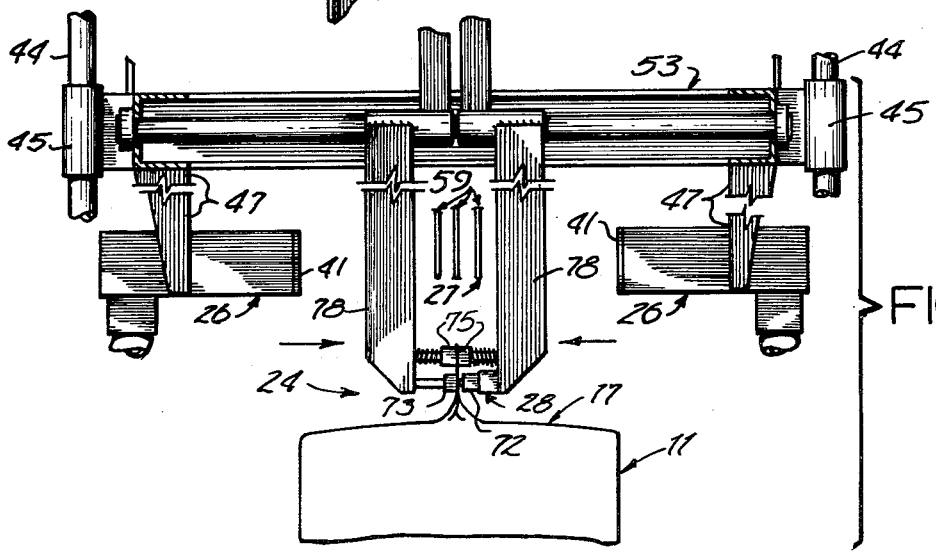
FIG 10

OPEN TOP PLASTIC BAG SEALER

BACKGROUND OF THE INVENTION

The present invention is related to the plastic bag sealing mechanism art and more particularly to such mechanisms that automatically seal successive upwardly open plastic bags that have been filled with a bulk material by clamping and heating the bag sides to a sufficient temperature to melt the plastic material and allow it to become fused.

There is a problem in closing and sealing of gusseted plastic bags that have been filled with a measured amount of compacted material. If the upwardly open bag ends are heat sealed by means of heated rollers pressing the full lengths of the sides together, an overlapping tab will project outwardly from either end of the bag. These tabs are unsightly and are somewhat hazardous in that they may be easily snagged and torn during warehousing and shipping operations. It is therefore desirable to produce a tucked or "gusseted" closed top that does not present outwardly projecting tabs and that produces a neater appearance of the finished packaged product.

It is a first object of the present invention to provide an apparatus whereby filled plastic bags may be closed and sealed to produce a neat appearing finished product without outwardly protruding tabs at the upper ends thereof.

Another object is to provide such a device that may be installed directly adjacent to a bag filling mechanism and may automatically receive and seal the open tops of bags received therefrom.

A further object is to provide such a device that will produce a tucked or "gusseted" sealed top on filled plastic bags in an automatic sequence, thereby requiring the presence of no more than one attendant.

These and still further objects and advantages will become apparent upon reading of the following description, which, taken with the accompanying drawings, describe a preferred form of the invention.

BRIEF DESCRIPTION OF THE DRAWINGS

A preferred form of the present invention is disclosed in the accompanying drawings in which:

FIG. 7 is an enlarged fragmentary pictorial view of a folding means of the present apparatus;

FIG. 8 is an enlarged diagrammatic view illustrating the function of the folding means;

FIG. 9 is an enlarged fragmentary pictorial view illustrating the bag sealing mechanism and associated elements; and FIG. 10 is a fragmentary view illustrating the operational features of the sealing means.

DETAILED DESCRIPTION OF A PREFERRED EMBODIMENT

Figure 1:
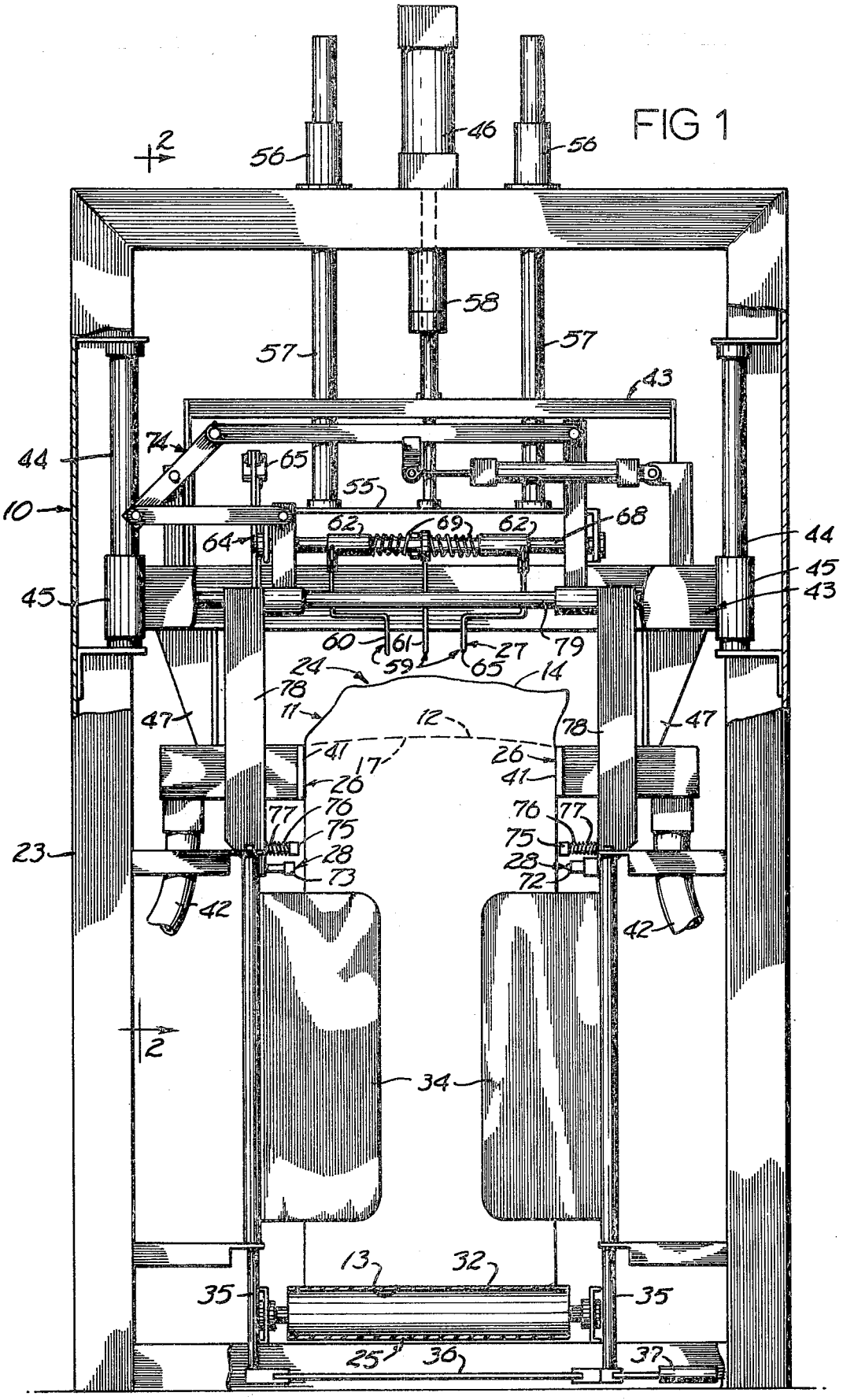
FIG. 1 is a fragmentary elevational frontal view of the present apparatus.
Figure 2:
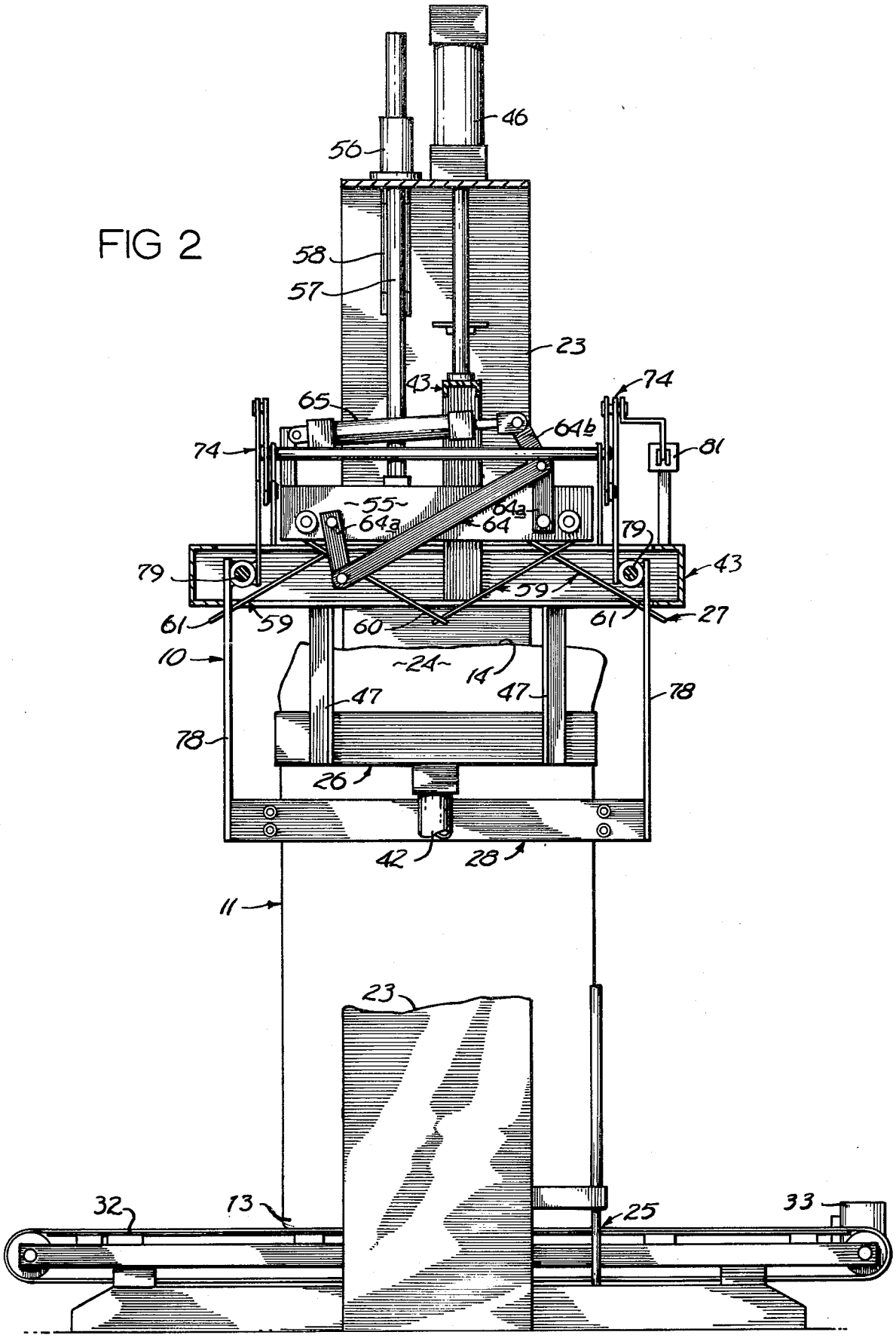
FIG. 2 is a sectioned elevational side view of the present apparatus taken from the line 2—2 in FIG. 1.
Figure 3:
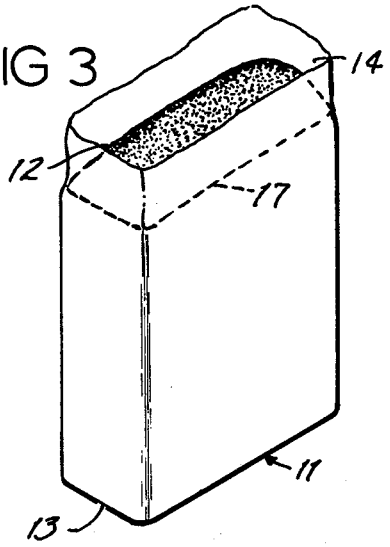
FIG. 3 is a pictorial view of an open filled plastic bag with an open upward end.
Figure 4:
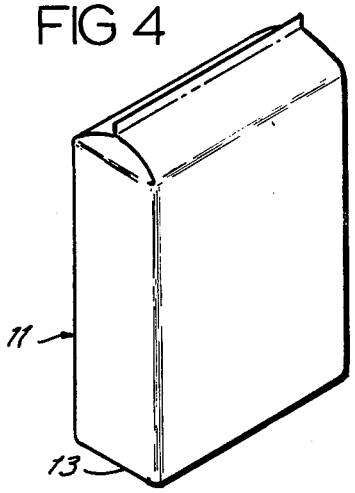
FIG. 4 is a pictorial view similar to FIG. 3 only showing the upper end in a closed sealed condition.

FIGS. 1 and 2 of the drawings illustrate the machine comprising a preferred form of the present invention. The machine is generally designated by the reference character 10. It is intended that the machine 10 be utilized to close and seal the upwardly open ends of successive filled plastic bags such as that illustrated at 11 (FIG. 3). The bags are closed and sealed from the configuration shown in FIG. 3 to the configuration shown in FIG. 4.

The individual bags 11 are filled with a bulk material 12 such as particulate insulation. If the bags are held within a form or "mold" while being filled, compaction of the material within the form will result in a predetermined outer bag configuration. This shape is preferably rectangular to facilitate stacking of the filled bags.

In using a standard "gusseted" plastic bag, a rectangular configuration may be obtained by packing the material within a complementary form. The filled bag includes a closed "gusseted" bottom 13 with an upwardly open top 14. The cross-sectional configuration of the bag includes longitudinal sides 15 and integral transverse sides 16. The material is compacted within the individual bags 11 to a level 17 therein that is spaced a prescribed distance below the open top 14. The plastic bag material between level 17 and top 14 is utilized to form the upper closed end configuration shown in FIG. 4.

Figure 6:
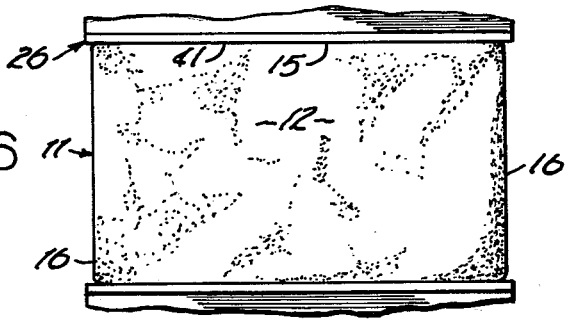
FIG. 6 is a plan view of the elements shown in FIG. 5.

The machine 10 includes a supportive framework 23 that is adapted to be mounted adjacent to a bag filling mechanism. The framework 23 locates a bag sealing station 24 where the operations are performed to produce the sealed upward bag ends. A locating means 25 is provided for positioning successive partially filled bags at the sealing station 24. An end forming means 26 is also included and operates upon the successive bags to form the upward open ends 14 into a substantially rectangular configuration as shown in FIG. 6. Folding means 27 operates upon the upper bag end to change the form shown by FIG. 6 to the folded condition shown in FIG. 8. Means 27 is shown in detail by FIGS. 2 and 7 of the drawings. Finally, a heat sealing means 28 is shown in detail by FIG. 9 to close and seal the plastic material of the folded bag sides together.

The locating means 25 is shown to best advantage in FIGS. 1 and 2. It is basically comprised of a longitudinal input conveyer 32. A standard drive 33 is provided on the framework 23 to operate conveyor 32 to move successive bags inwardly to the sealing station 24. Also included with the locating means 25 is a pair of pivoted doors 34. These doors extend into the path of bags moving on the input conveyor 32 and are strategically located so as to stop forward progresson of a bag at the sealing station 24. The conveyor 32 may be operated continuously so its working flight will slide beneath a bag halted at the sealing station 24, or it may be operated intermittently to move a bag into engagement with the doors 34 and then halt operation while the forming and closing steps are performed.

The doors 34 are mounted to pivots 35 and are swung to opened and closed position through a linkage 36 and cylinder 37. The cylinder 37 is actuated in response to functioning of the heat sealing means 28.

The forming means 26 is shown in detail by FIGS. 1, 5, 6, and 9. It includes laterally spaced facing suction plates 41. These plates 41 operate to provide pneumatic suction through hose assemblies 42 to engage and slidably hold the longitudinal sides 15 of the successive bags 11. The plates 41 are mounted to a vertically movable carriage 43 (FIG. 10) that is capable of moving the plates 41 from a lowered position adjacent and below the material level 17 (dashed lines FIG. 5) to an elevated condition directly adjacent the upwardly open bag top 14 (solid lines FIG. 5). This vertical movement along with the suction produced through plates 41 serves to form the successive bag tops into prescribed rectangular configuration as shown in FIG. 6. This is essential to the proper functioning of the folding means 27.

Figure 5:
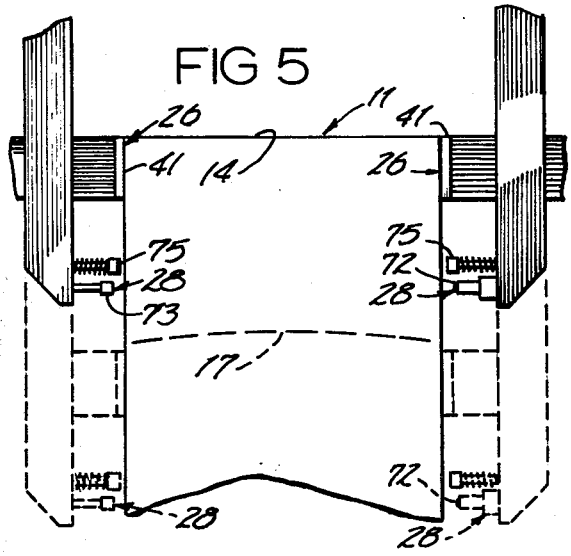
FIG. 5 is a diagrammatic operational view illustrating the top forming function.

The carriage 43 is in the form of an open rectangular frame that is slidably mounted through spaced sleeves 45 to upright guides 44. A cylinder 46 is operatively interconnected with the framework 23 and carriage 43 for selectively moving the carriage between raised and lowered positions, causing corresponding movement of the suction plates 41. The suction plates 41 are held laterally stationary relative to the carriage 43 by upright brackets 47. Thus, the motion of plates 41 is in direct response to operation of cylinder 46 and their paths are vertical as shown by FIG. 5.

The folding means 27 is shown in particular by FIGS. 2, 7 and 8. Its function is to fold the transverse bag sides 16 inwardly to the configuration shown in FIG. 8 where they are overlapped longitudinally by the longitudinal sides 15. The transverse sides 16 are thereby "tucked" between the longitudinal sides 15 prior to the sealing operation. This function eliminates the excess material that ordinarily protrudes longitudinally to the sides of the bags when a conventional roller type heat sealing assembly utilized.

The folding means 27 is mounted to an independent carriage 55 that moves vertically independently of the carriage 43. It is slidably mounted to the framework 23 through upright guides 56 and slides 57. The guides 56 are mounted directly to the framework 23 to slidably receive the slide bars 57 therein. A ram cylinder 58 is provided to interconnect the framework 23 and carriage 55 in order to move the carriage vertically and independently of the forming means 26.

The carriage 55 pivotably receives a folding finger means 59 by which the transverse sides 16 are folded. The folding finger means 59 is comprised of two pairs of finger members 60 that are spaced apart longitudinally with the fingers of each pair being spaced apart transversely. The fingers 60 are utilized to engage and form outside corners of the folded configuration. Also included are two inner fold fingers 61. These fingers pivot in opposite directions than the fingers 60 and are utilized to hold the transverse sides inwardly toward one another.

The finger pairs 60 are each adjustably mounted to a pivot bracket 62. Brackets 62 in turn are slidably mounted to rods 68 which are pivotably mounted to carriage 55. The brackets 62 slide on rods 68 and are normally held apart by compression springs 69. Finger members 61 are mounted to independent pivot brackets 63 and rods 70. A linkage 64 interconnects the pivot rods 68 and 70. A cylinder 65 is mounted between linkage 64 and carriage 55 as means for pivoting the fingers 61 in an arcuate path defined by the axes of rods 68 and 70. The linkage 64 is comprised of crank arms **64*a* mounted directly to pivot rods 70. An elongated elbow link 64*b* pivotably interconnects the arms 64*a* and is mounted at one end thereof to the piston end of cylinder 65**.

Extension and retraction of cylinder 65 results in corresponding pivotal movement of the rods 70 and their associated inner fold fingers 61. The fingers will pivot in opposite directions about an arc from the position shown in FIG. 2 to the upright position shown in FIGS. 7 and 8. This movement is such that the transverse bag sides 16 are engaged by fingers 61 and moved longitudinally inward toward one another.

The rods 70 each include a gear wheel 66 that is meshed with a corresponding gear wheel 67 on an adjacent pivot arm 62. Pivotal movement of rod 70 will result in corresponding pivotal movement of rods 68. The transmission of rotation is reversed through the gear train so the fingers 60 will pivot in opposite directions to the fingers 61. Therefore, the corner finger pairs 60 will pivot downwardly and longitudinally from the position illustrated in FIG. 2 to the upright position shown in FIGS. 7 and 8.

The heat sealing means 28 is illustrated in substantial detail by FIGS. 1, 2, 5, and 9. Means 28 is simply comprised of a longitudinal heat element bar 72 that is located on one longitudinal side of a bag located at the sealing station and a complementary pad 73 located on the opposite longitudinal side. Element 72 and pad 73 are opertively mounted to carriage 43 for vertical movement therewith. However, these elements are also transversely movable through functioning of a linkage means 74.

A laterally spaced pair of advance bars 75 are provided for movement with the heat element 72 and pad 73. The advance bars 75 are mounted through guide rods 76 and compression springs 77 to depending brackets 78. Brackets 78 also provide support for the element 72 and pad 73. The advance bars 75 are spaced apart laterally by a distance less than the lateral distance between heat element 72 and pad 73. The bars 75 are utilized to engage and press the longitudinal bag sides 15 together prior to engagement therewith by the heat element 72. Once the bars 75 come together against sides 15, the guide rods 76 slide within brackets 78 against springs 77 allowing the heat element 72 and pad 73 to continue their transverse inward movement toward engagement with the sides 15.

The brackets 78 are mounted to transverse slide bars 79 at their upper ends. The linkage 74 interconnects the brackets 78 and is connected through a cylinder 81 to carriage 43. Operation of cylinder 81 serves to slide the brackets 78 along bars 79 toward or away from each other. One side of linkage 74 is shown in FIG. 9, the other side being identical. The linkage 74 includes a first link **80*a* that is pivotably mounted to an upstanding arm 78*a* of one bracket 78 and extends therefrom to one side of a toggle 80*b*. Toggle 80*b* is pivotably mounted at its center to a bracket 83 of carriage 43. The opposite end of toggle 80*b* is connected to an elongated link 80*c*. The remaining end of link 80*c* is connected to an upright bracket 80*d* affixed to the opposite bracket 78. Cylinder 81 is connected between elongated link 80*a* and the carriage 43**.

Thus, it may be seen that the heat sealing means 28 is vertically movable through function of cylinder 46 for raising and lowering suction plates 41 and, in addition, is laterally movable through provision of the linkage 80 and cylinder 81.

An operational cycle of the present apparatus is initiated as a filled bag 11 is placed on the conveyor 32 and is moved thereby to the sealing station 24. Forward progression of the bag is halted at the station 24 by the doors 34 which are normally held in a closed position.

A limit switch (not shown) is actuated as the bag moves into abutment with doors 34. This switch closes a circuit to initiate sequential operation of the forming means 26, folding means 27, and heat sealing means 28.

The first operation initiated in response to reception of a filled bag at the sealing station 24 is the upward movement of suction plates 41 to straighten the bag sides and form the rectangular configuration at the top 14 thereof. This step is accomplished through operation of cylinder 46. The different positions of plates 41 is indicated in FIG. 5 and the resulting configuration of the bag top is shown in FIG. 6.

As the carriage 43 reaches an elevated position, another limit switch is actuated. This switch controls functioning of the folding means 27. Thus, once the plates 41 complete their function of forming the rectangular configuration of top 14, the cylinder 65 is actuated to pivot the fingers 60 and 61 to engage the transverse sides 16. The finger pairs 60 hold the outer corners of the folds while fingers 61 move inwardly to pull and hold the sides 16 in the configuration shown in FIG. 8. In the folded configuration, the transverse sides 16 are overlapped completely by the longitudinal bag sides 15. The fingers 60 and 61 are held in this position while the heat sealing means 28 closes on the longitudinal sides.

Immediately as the fingers 60 and 61 complete the folding operation, the cylinder 81 is actuated to move the advance bars 75 and heat sealing means 28 laterally toward the sides 16. After the advance bar 75 engage sides 15, the cylinder 58 is operated to lift carriage 55 upwardly to disengage the fingers 60 and 61 from between bars 75 and the folds of the bag 11. Continued transverse inward movement of the brackets 78 bring the heat element 72 and pad 73 into engagement with the full lengths of sides 15.

The heat element 72 is held at a constant temperature sufficient to melt the plastic bag material after direct engagement therewith for a prescribed time. Thus the element 72 is held clamping the sides 15 together against pad 73 until sufficient time has elapsed and the plastic material has melted and fused together adjacent the element 72. At this point the element 72 and pad 73 are retracted from engagement with the sides to allow the fused materials to cool and solidify. The sprung advance bars 75 will hold the fused sides together for a short period of time as the element 72 and pad 73 are retracted. This allows the material to solidify and cool before being released.

At last, when the advance bars 75 disengage the bag sides 15, a completed sealed top has been formed and the bag may be removed for further processing. The doors 34 are actuated to open by cylinder 37 to allow the bag to move on toward a discharge end of conveyor 32. As the bag moves away from the sealing station 24, the fingers are pivoted back to the position as shown in FIG. 2 and carriages 43 and 55 are repositioned at their normal lowered elevations to await reception of the next successive bag.

The above description was given by way of example to disclose a preferred form of the present invention and was not intended to restrict the scope thereof. Only the following claims are to be taken as definitions placing limitations on the scope of the invention.

What I claim is:

1. Apparatus for closing and sealing the upwardly open ends of upright flexible plastic bags that have been filled with a formable material, comprising:

a framework;

bag locating means on said framework for positioning successive bags at a closing and sealing station;

spaced facing suctions means for engaging and forming the open bag end;

a vertically movable carriage on said framework supporting the suction means;

means for moving the carriage vertically from a lowered position wherein the suction means are located at an elevation below the level of material within a bag at the sealing station and a raised position with the suction means at an elevation even with the upwardly open end of the bag to form the open bag end into a rectangular configuration with integral longitudinal and transverse sides;

folding means for engaging the transverse bag sides and folding them inwardly in such a manner that they become overlapped by the longitudinal sides; and heat sealing means on said framework adapted to press the longitudinal sides together over the folded transverse sides and fuse the plastic material thereof together.

2. The apparatus as set out by claim 1 wherein the folding means is comprised of:

two sets of fingers on the frame above a bag at the sealing station;

means operatively connected to said two sets of fingers for moving the fingers downwardly into engagement with the transverse sides of the bag and for moving the sets of fingers in opposite longitudinal directions while engaged with the transverse bag sides to thereby fold the transverse bag sides to thereby fold the transverse bag ends.

3. The apparatus as set out by claim 2 wherein the sets of fingers are pivoted to a vertically movable carriage on the framework and swing downwardly in opposite directions to engage and fold the transverse bag ends.

4. The apparatus as set out by claim 1 wherein the heat sealing means is comprised of a longitudinal heat element movably mounted to the framework on one side of a bag at the sealing station, and a longitudinal pad movably mounted to the framework on an opposite bag side and further includes linkage means for moving the heat element and pad together against the bag sides.

5. The apparatus as set out in claim 4, further including spring loaded advance bars operatively connected to the heat element and pad for engaging and pressing the bag sides together before engagement therewith by the heat element and pad.

6. The apparatus as set out in claim 1 wherein the heat sealing means is comprised of a longitudinal heat element movably mounted to the framework on one side of a bag at the sealing station, and a longitudinal pad movably mounted to the framework on an opposite bag side and further includes means for moving the heat element and pad together against the bag sides.

7. The apparatus as set out in claim 6 further including spring loaded advance bars operatively connected to the heat element and pad for engaging and pressing the bag sides together before engagement therewith by the heat element and pad.

8. The apparatus as set out by claim 1 wherein the folding means is comprised of:

two sets of fingers on the frame above a bag at the sealing station;

means operatively connected to said two sets of fingers for moving the fingers downwardly into engagement with the transverse sides of the bag and for moving the sets of fingers in opposite longitudinal directions while engaged with the transverse bag sides to thereby fold the transverse bag ends.

* * * * *